US007172309B2

(12) United States Patent
Parsons

(10) Patent No.: US 7,172,309 B2
(45) Date of Patent: Feb. 6, 2007

(54) MINIATURE LED FLASHLIGHT HAVING SPLIT RING

(75) Inventor: Kevin L. Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 154 days.

(21) Appl. No.: 10/624,373

(22) Filed: Jul. 22, 2003

(65) Prior Publication Data

US 2005/0018421 A1 Jan. 27, 2005

(51) Int. Cl.
*F21L 4/00* (2006.01)

(52) U.S. Cl. ..... 362/196; 362/116

(58) Field of Classification Search ..... 362/196, 362/200, 201, 116
See application file for complete search history.

(56) References Cited

U.S. PATENT DOCUMENTS

| | | | | |
|---|---|---|---|---|
| 5,158,356 | A * | 10/1992 | Guthrie | 362/188 |
| 6,299,323 | B1 * | 10/2001 | Yu et al. | 362/116 |
| 6,435,695 | B1 * | 8/2002 | Altman | 362/189 |
| 6,582,097 | B2 * | 6/2003 | Chang | 362/253 |
| 6,626,019 | B1 * | 9/2003 | Huang | 70/456 R |
| 6,761,468 | B1 * | 7/2004 | Bogal | 362/208 |
| 2003/0137833 | A1 * | 7/2003 | Hsu | 362/196 |

* cited by examiner

*Primary Examiner*—Stephen Husar
*Assistant Examiner*—Peggy A. Neils
(74) *Attorney, Agent, or Firm*—Welsh & Katz, Ltd.

(57) ABSTRACT

A flashlight includes a light emitting diode, power source, momentary contact switch for manually activating the flashlight, and a split-ring clip for attachment to key-rings, baggage, and various articles of clothing. The flashlight body includes an interchangeable bottom wall, suitable for engraving, printing, silk screening, or stamping.

29 Claims, 4 Drawing Sheets

2/4

MINIATURE LED FLASHLIGHT HAVING SPLIT RING

BACKGROUND OF THE INVENTION

The present invention relates generally to flashlights, and more particularly to a miniature flashlight having a light emitting diode (LED) light source that is useful for law enforcement personnel and civilians alike.

Conventional general-purpose flashlights are well known in the art and have often been used by law enforcement personnel in the execution of their duties and in emergency situations. Flashlights are used for a wide variety of purposes. For example, they are often used during traffic stops to illuminate the interior of a stopped vehicle or to complete a police report in the dark. They are also used to facilitate searches of poorly lit areas, and may be used to illuminate dark alleys or stairwells. Law enforcement personnel also use flashlights to check or adjust their equipment when positioned in a darkened area or at night, and may also be used to send signals to one another. Consequently, it is common, and frequently required, for law enforcement personnel to carry a flashlight, as well as other law enforcement equipment, such as a sidearm, handcuffs, and intermediate force weapons such as an expandable baton. With such a large number of items, it is often difficult and cumbersome for law enforcement personnel to carry all of these items on their person so they can be accessed.

Generally, conventional flashlights employ an incandescent light bulb and dry cell batteries enclosed in a housing typically having an elongated cylindrical body section and a head section. Flashlights of this type are often bulky and cumbersome. Law enforcement personnel often wear a holster to carry a flashlight on their person. However, the inconvenient size and weight of conventional flashlights reduce the mobility of law enforcement personnel required to carry such flashlights along with other law enforcement equipment. As a result, the flashlight may purposefully or inadvertently be left, presenting a problem when the need for a flashlight arises and the officer does not have one readily available.

Civilians also find a variety of uses for flashlights. Besides traditional home uses, small flashlights are favored for various security purposes. For example, when going to one's car during darkness, it is not uncommon for an individual, especially a female, to carry a small flashlight to assist in locating the door lock keyhole or to check for potential assailants. Even small conventional flashlights, however, can be cumbersome and inconvenient to carry for this purpose.

To overcome the bulk and weight disadvantages of traditional flashlights, small compact hand-held flashlights utilizing LED light sources and small, coin-type battery power sources have been developed. See, for example, U.S. Pat. No. 6,190,018 that is assigned to the assignee of the present invention and incorporated hereby by reference in its entirely. Such compact, lightweight flashlights easily may be carried on one's person. Some are adapted to attach readily via spring-biased means to a key chain or to clothing, such as buttonholes, belt loops, or the like. However, no known lightweight LED flashlights are readily adapted to be actuated when selectively inserted into a case or carrier, that in turn is adapted to be attached to the user's person, such as to a hat brim or backpack. Such attachment facilitates directional positioning of the light beam without hand manipulation.

Typically, known small, LED flashlights require slide or pressure switches that directly engage LED leads to batteries in order to actuate the light. This results in increased fatigue on the LED leads, and adversely affects switch reliability. In addition, many small flashlights are constructed with hard plastic outer shells unsuitable for marking, etching, or interchanging. Other small flashlights may include an integral clip for attachment to clothes, baggage, or keys, but they generally have spring-biased locking mechanisms, which are vulnerable to breakage and typically require extra parts and expense in manufacturing. Further, most flashlights require at least partial human assembly, which is a relatively labor-intensive process and expensive.

It thus follows that a miniature LED flashlight with a momentary contact switch, interchangeable body inserts, top covers suitable for marking, and an integral, split-ring clip would provide significant advantages over prior known small flashlights. Complete automation of the assembly process would significantly reduce human error inherent in flashlight assembly, significantly increase the number of lights able to be produced in a given period of time, and greatly lower the price per unit.

A number of "hat-mounted" and "tool-mounted" flashlights are described in the prior art. Such devices, however, typically use incandescent bulbs and dry cell batteries. One such hat-mounted device is activated when a user dons the hat. Another is activated when a user twists a flashlight barrel, or otherwise activates a switch. One known tool-mounted flashlight is activated when an insulating tab disposed between switch contacts is removed.

These known hat-mounted and tool-mounted flashlights require manual interaction to activate and deactivate the light. Thus, a miniature flashlight and an associated case adapted to be releasably attached to a support (such as a hat brim or other article of clothing), wherein the flashlight may be activated either manually or when selectively inserted into the case, would provide significant advantages over known flashlights and associated cases or carriers.

SUMMARY OF THE INVENTION

One of the objects of the present invention is to provide a small, compact flashlight that may be activated manually and is adapted to be automatically activated when the flashlight is selectively inserted into a case or carrier.

A more particular object of the invention is to provide a miniature flashlight that includes a momentary contact switch, interchangeable body inserts, and an integral, split-ring clip. The case or carrier slideably receives the flashlight and includes a resilient mounting clip that allows attachment to an article of clothing or other support member.

A feature of the present invention lies in the provision of a dome plate switch element, preferably located between one of the LED leads and the power source, but out of direct contact with the power source. The switch is activated by applying pressure to a switch button, which forces one of the LED leads into contact with the dome plate, which in turn contacts the power source and completes a circuit. Once pressure is removed from the switch button, contact between the dome plate and power source is broken, and the flashlight turns off. By preventing direct contact between the LED leads and the power source, this switching arrangement reduces wear on the LED leads and increases switch reliability.

Another feature of the present invention lies in the interchangeability of body inserts that allows the flashlight to be marked, engraved, or imprinted. Body inserts may be made of a variety of plastic materials. Indicia may be engraved, silk screened, inked, pad printed, foil stamped, or marked in any known manner.

Yet another feature of the present invention lies in the provision of an integral, split-ring clip for connecting the flashlight to key rings, backpacks, or other baggage. The split-ring clip is manufactured from resilient material and is designed to remain closed, unless intentionally twisted open.

Further objects, features, and advantages of the present invention, together with the organization and manner of use thereof, will become apparent from the following description of the invention when taken in conjunction with the accompanying drawings, wherein like reference numerals designate like elements throughout the several views.

While the present invention is susceptible to various modifications and alternative forms, and specific embodiments thereof are shown by way of example in the accompanying drawings and will be described in detail. It should be understood that the drawings and detailed description thereof are not intended to limit the invention to the particular form disclosed, but rather the invention is intended to cover all modifications, equivalents, and alternatives falling within the spirit and scope of the present invention.

DETAILED DESCRIPTION

Figure 1:
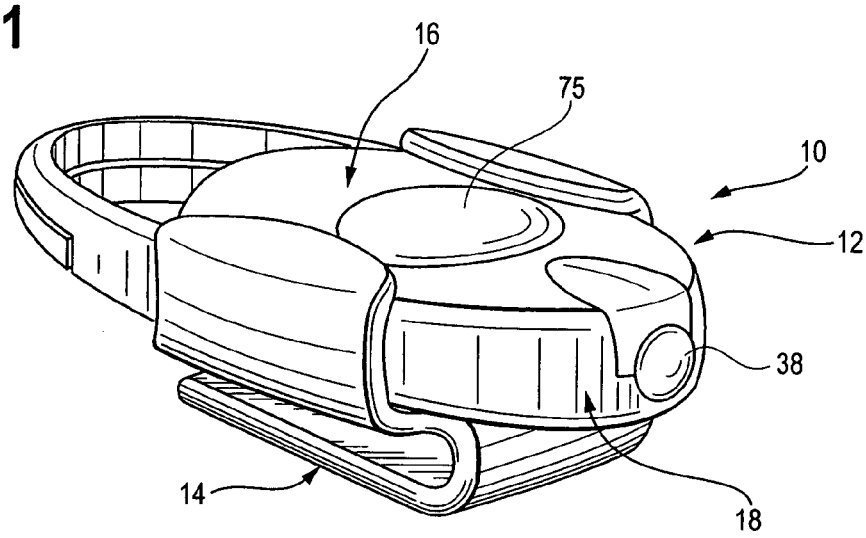
FIG. 1 is a perspective view of a flashlight and case assembly in accordance with a preferred embodiment of the present invention, with the flashlight oriented with its switch exposed upwardly so as not to be actuated by the case.
Figure 2:
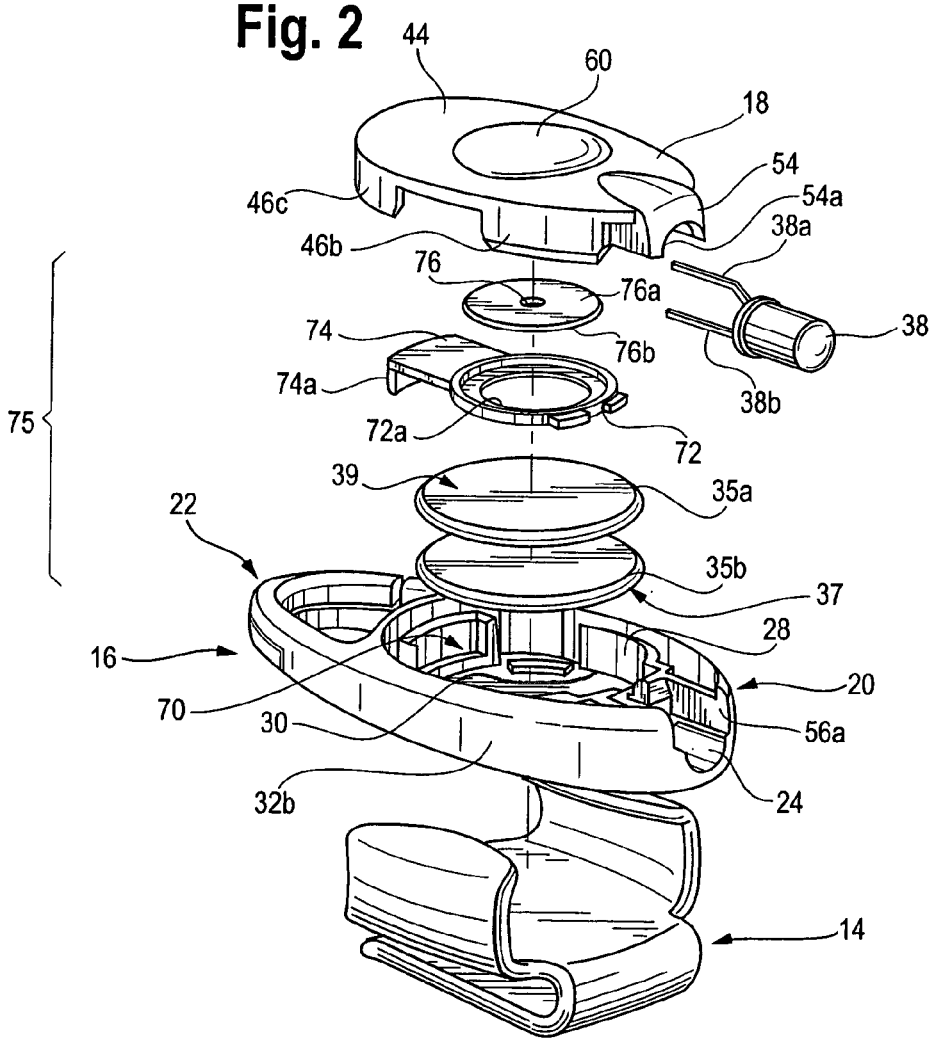
FIG. 2 is an exploded view of the flashlight and case assembly of FIG. 1.

Referring now to the FIGS. 1 and 2, a miniature flashlight assembly 10 is shown for attachment to a support, such as an article of clothing or baggage, constructed in accordance with the principles of the present invention. The flashlight assembly 10 includes a miniature flashlight 12 and a mating flashlight case or carrier 14. Attaching the flashlight 12 and case 14 to a support, such as a user's hat brim, allows direction of a light beam toward a specific location, leaving both of the user's hands free for other uses. Preferably, the flashlight 12 has an overall longitudinal length of approximately 2 inches, a traverse width of approximately 0.95–1.0 inch, and a maximum transverse thickness of approximately ⅜ inch. The flashlight 12 preferably uses a light emitting diode (LED) 38 as a light source and a pair of coin-type 3-volt batteries 35*a* and 35*b* as a power source. A momentary contact switch 75, to be described, preferably activates the LED.

The flashlight 12 is adapted to be inserted into the case or carrier 14 in either of two positions. In one position, as illustrated in FIG. 1, the flashlight 12 is inserted into the case 14 so that the momentary contact switch 75 is exposed upwardly, without contacting the case, thus permitting the flashlight to be in an "OFF" state. Thus oriented, the flashlight 12 will remain in an "OFF" state until the momentary contact switch 75 is manually actuated. In a second position (not shown), the flashlight 12 is rotated 180 degrees about its longitudinal axis ("flipped-over") and inserted into the case or carrier 14 so that the momentary contact switch 75 faces the case. This causes the momentary contact switch 75 to be depressed by a portion of the case or carrier, thus maintaining the flashlight 12 in an "ON" state by interaction of the momentary contact switch against the main body 84 of the case 14.

Figure 3:
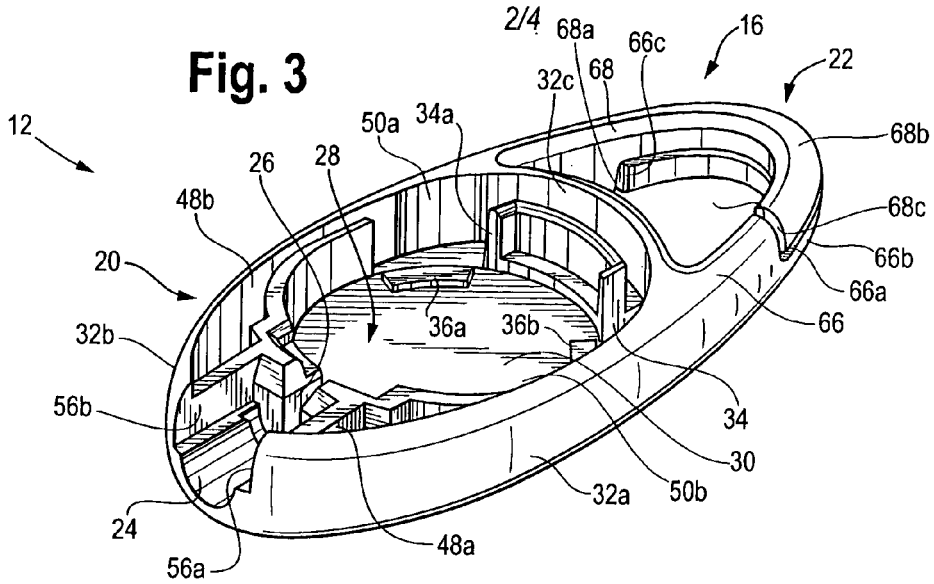
FIG. 3 is a perspective view of the flashlight body shown in FIG. 2.

Referring now to FIGS. 1–3, the flashlight 12 includes a body 16 and a top cover 18 releasably mounted on the body 16. The body 16 is preferably made of a plastic material that lends itself to molding. Preferably, the body 16 has a generally elliptical shape, having a forward end 20 and a rearward split-ring clip end 22 formed integrally with the body. The forward end 20 receives and retains the light source 38 and the batteries 35*a* and 35*b*. The forward end 20 also is generally oval-shaped, and has a semi-cylindrical light source receiving recess 24 formed therein. The light source receiving recess 24 intersects the forward end 20 of the body 16, and communicates with a channel 26, which in turn communicates with a generally circular power source receiving recess 28 formed within the forward end 20. A generally oval bottom wall 30 is integrally formed with and secured to lower margins of outer sidewalls 32*a*, 32*b*, and to a lower margin of a wall 32*c*. An upstanding arcuate-shaped stub wall 34 preferably is formed integral with the bottom wall 30 and has an inwardly exposed arcuate surface 34*a* that forms a partial boundary of the power source receiving recess 28.

The body 16 of the flashlight 12 may be replaceable or interchangeable, allowing the flashlight to display a variety of indicia, such as text, graphics, corporate logos, and the like, which may be marked, engraved, or imprinted. Alternately, the bottom wall 30 of the flashlight 12 may be replaceable within a particular body 16. For this purpose, the body 16 and the bottom walls 30 may be made of a variety of plastic materials. As mentioned above, various indicia may be engraved, silk screened, inked, pad printed, foil stamped, or marked in any known manner. Because the body 16 and top cover 18 are manufactured as separate components of the flashlight 12, they may be produced in different colors, allowing the flashlight to be assembled in varying and contrasting colors.

The power source may be any type of battery with sufficient power to energize the light source. As shown in FIG. 2, the power source is preferably one or more circular batteries 35*a* and 35*b* having generally flat, oppositely disposed parallel sides. In a preferred embodiment, the power source consists of two 3-volt lithium coin cell batteries 35*a* and 35*b*, such as Panasonic CR2016 batteries. Lithium batteries provide for exceptionally long life and durability, operate at a low temperature, and are leak-proof and vibration resistant.

Figure 4:
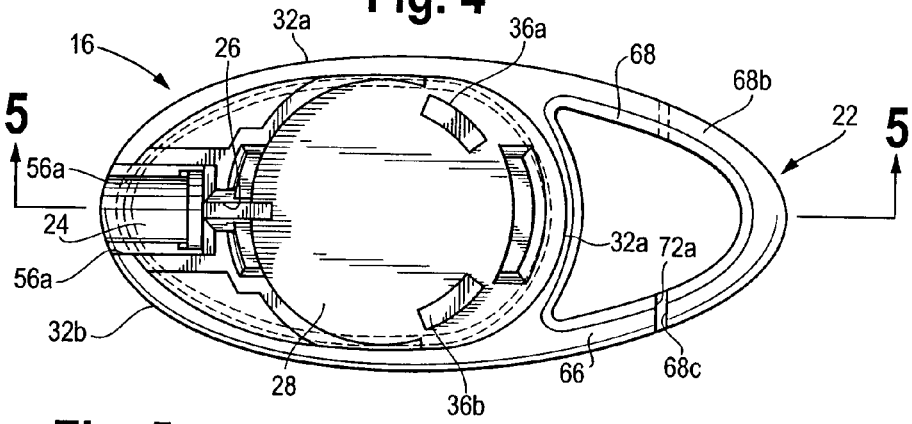
FIG. 4 is a plan view of the flashlight body shown in FIG. 3.

Referring to FIGS. 3 and 4, a pair of arcuate spacers 36*a* and 36*b* are preferably formed integrally with the bottom wall 30 so as to maintain the lower battery 35*b* spaced slightly above the inner surface of the bottom wall 30. Thus, a lower lead 38*b* of the LED light source 38 may be inserted so as to underlie a lower surface 37 (preferably the negative pole) of the lower battery 35*b*.

Figure 7:
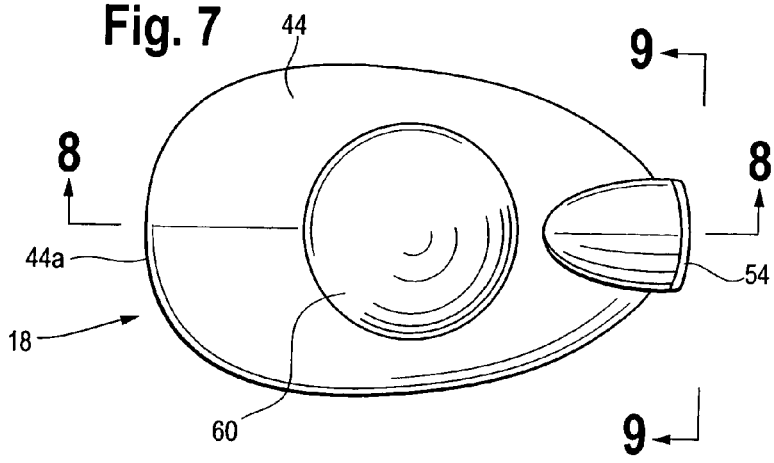
FIG. 7 is a plan view of the top cover of the flashlight body shown in FIG. 2.

Turning to FIG. 7, the top cover 18 is also made of a plastic, moldable material, such as an elastomeric material. The top cover 18 includes a top surface portion 44 having a generally elliptical outer peripheral edge 44*a*. The outer peripheral edge 44*a* is similar in shape to the upper marginal edges of the peripheral walls 32*a–c* of the body 16. Referring to FIGS. 2 and 8–10, the top cover 18 includes depending wall segments 46*a–d* that preferably are formed integral with the top surface 44 and depend from selected positions about the periphery of the top surface. The depending wall segments 46*a* and 46*b* are configured to slidably insert into recesses 48*a* and 48*b* respectively, formed in the body 16. Depending wall segments 46*c* and 46*d* are also configured to slidingly engage wall surfaces 50*a* and 50*b* respectively, formed in body 16. Thus, the top cover 18 is frictionally retained in assembled relation on the body 16.

Returning to FIGS. 7 and 10, the top cover 18 also includes a slightly forwardly extending and downwardly depending block portion 54. The block portion 54 fits between and cooperates with between parallel wall surfaces 56*a* and 56*b* (FIG. 3) formed in the body 16. A semi-cylindrical surface 54*a* of the block portion 54 overlies and compliments the semi-cylindrical surface of the light source receive recess 24, establishing a cylindrical opening to snuggly receive and retain the LED 38.

Figure 8:
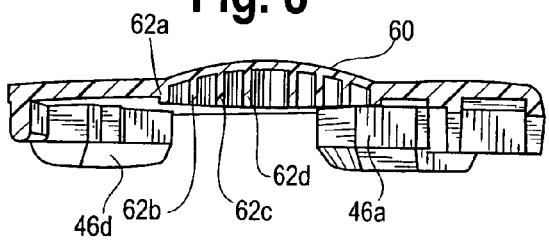
FIG. 8 is a longitudinal sectional view taken substantially along line 8—8 of FIG. 7.
Figure 9:
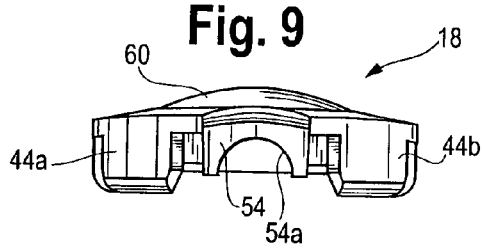
FIG. 9 is a front elevational view taken substantially along line 9—9 of FIG. 7.
Figure 10:
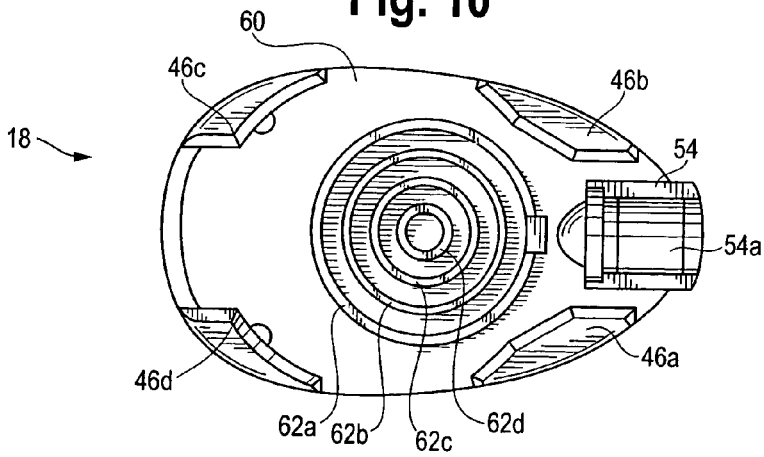
FIG. 10 is a bottom view of the top cover of FIG. 7.

As illustrated in FIGS. 8–10, the top cover 18 includes a switch actuator button 60 in the form of an integral, convex, generally centrally located protrusion from the top surface 44. The underside of the actuator button 60 has a plurality of integrally formed concentric depending rings 62*a–d*. The lower marginal edges of the depending rings 62*a–d* generally lie in a common plane, substantially parallel to the upper wall 44 of the top cover 18. As will be described, the depending rings 62*a–d* actuate the flashlight's 12 momentary contact switch 75 when it is depressed manually, or upon selective insertion of the flashlight into the case or carrier 14. The actuator button's 60 elastic characteristics cause it to return to its normal configuration, as illustrated in FIG. 8, when it is released.

Returning to FIGS. 3–6, the split-ring clip end 22 includes a first arcuate extension 66 formed integral with the forward portion 20 of the body 16. The first arcuate extension 66 is stepped at 66*a* to define a lower arcuate extension 66*b* that terminates at an end surface 66*c*. The end surface 66*c* is disposed opposite a stepped surface 68*a* formed on a second upper arcuate extension 68. The second upper arcuate extension 68 also is formed integral with the forward portion 20 of the body 16, and includes an upper arcuate extension 68*b* that terminates at a terminal end surface 68*c* disposed opposite the stepped surface 66*a* of the first arcuate extension 66.

Figure 5:
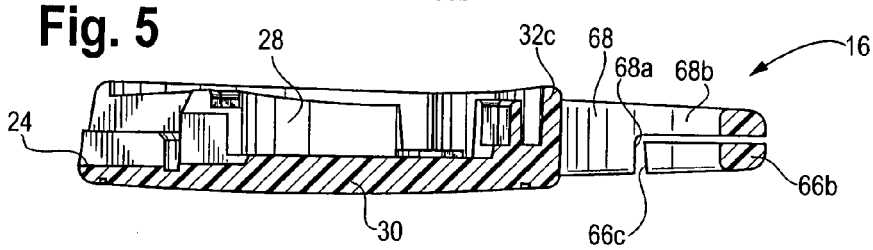
FIG. 5 is a longitudinal sectional view taken substantially along line 5—5 of FIG. 4.
Figure 6:
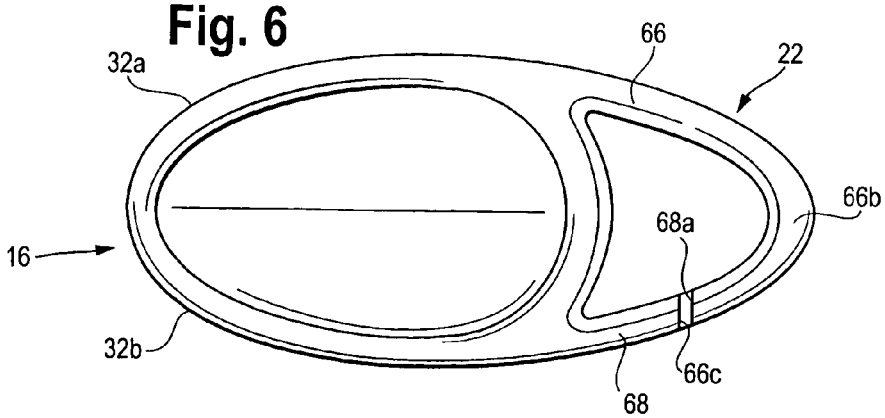
FIG. 6 is a bottom view of the flashlight body shown in FIG. 4.

As illustrated in FIG. 5, the first and second arcuate segments 66*b* and 68*b* of the split-ring clip end 22 are resilient and have planar, laterally opposed, spaced-apart surfaces. Thus, one or both of the arcuate extensions 66*b* and 68*b* may be spread apart from each other. Either of the terminal ends 66*c* or 68*c* may be spread, enabling the assembled flashlight 12 to be releasably attached to a keychain, a button opening, backpacks, or other baggage, allowing hands-free use of the flashlight separately from its case 14. The split-ring clip 22 is extremely strong and cannot fall open accidentally. The unitized design of the split-ring clip 22 eliminates the need for an expensive and unreliable spring-with-hub design, as is found on much of the prior art.

Referring back to FIG. 2, an electrically nonconductive annular spacer 72 overlies and contacts an upper surface 39 of the upper battery 35*a*. The spacer 72 has an electrically nonconductive, L-shaped arm 74, having a depending portion 74*a* configured to be received within a slot 70 defined in the upstanding stub wall 34. The depending portion 74*a* of the arm 74 generally centers the annular spacer 72 on the battery 35*a*.

The spacer 72 has an upstanding annular rim 72*a* that forms a retaining groove to receive a conductive, circular dome plate switch 76. The dome plate switch 76 has a convex upper surface 76*a* and a concave lower surface 76*b*. The lower surface 76*b* is spaced apart from the surface of the battery 35*a* by the spacer 72, and thus without pressure applied to the switch, it is normally out of contact with the upper battery. The dome plate switch 76 preferably is made of a thin, flexible conductive metal, which flexes, allowing a centrally depending contact nib 76*a* to contact the upper battery 35*a*. When such contact occurs, a complete electrical circuit is made between the batteries 35*a*, 35*b*, switch 76 and LED 38, thus activating the LED.

To assemble the flashlight 12, first the LED light source 38 is placed within the light source receiving recess 24. The lower lead 38*b* rests on the bottom wall 30. Next, the lower battery 35*b* is placed within the power source receiving recess 28. The lower LED lead 38*b* therefore lies under, and is in contact with the lower battery 35*b*. The upper battery 35*a* is then positioned on top of the lower battery 35*b*. Next, the spacer 72 is placed on top of the upper battery 35*a* with the depending portion 74*a* of the arm 74 inserted into the slot 70. The dome switch place 76 is then laid within the rim 72*a* of the spacer 72, with its depending contact nib 76*a* adjacent the upper surface 39 of the upper battery 35*a*. An upper lead 38*a* of the LED 38 then is placed on top of and in contact with the upper surface 76*a* of the dome switch place 76.

Next, the top cover 18 is mounted on the body 16. When the switch actuator button 60 is depressed, the annular rings 62*a–d* located on the underside of the switch actuator button 60 cause the dome switch plate 76 to flex downwardly. Once the dome switch plate 76 is flexed, its contact nib 76*a* engages the upper surface 39 of the upper battery 35*a*. A circuit including LED contacts 38*a* and 38*b*, dome switch plate 76, and batteries 35*a* and 35*b* thereby is closed, energizing the LED 38. Releasing the switch actuator button 60 allows it to return to its normal, convex state, which allows the dome switch plate 76 to return to its normal position whereby the contact nib 76*a* is spaced apart from the upper surface 39 of the upper battery 35*a*, thus opening the circuit and returning the LED 38 to an "OFF" state.

Figure 11:
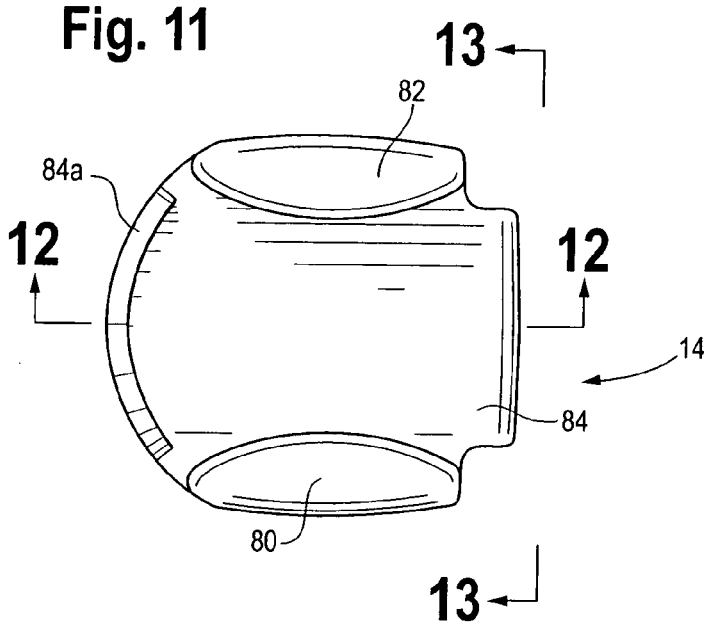
FIG. 11 is plan view of the case illustrated in FIG. 1.
Figure 12:
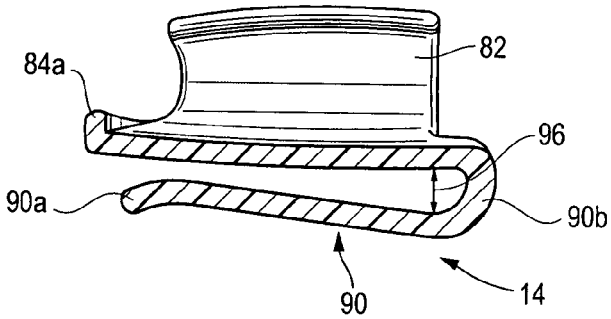
FIG. 12 is a longitudinal sectional view taken substantially along line 12—12 of FIG. 11.
Figure 13:
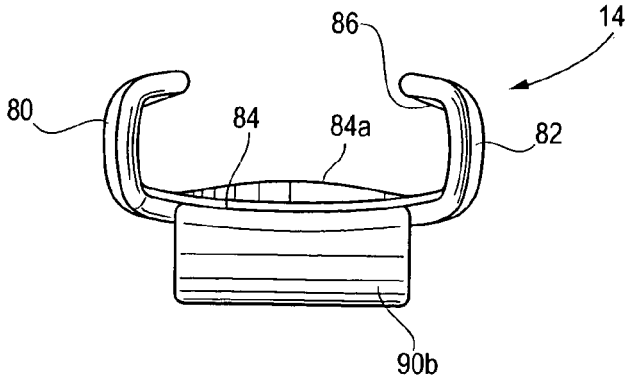
FIG. 13 is an end elevational view taken substantially along line 13—13 of FIG. 11.

Referring now to FIGS. 11–13, the flashlight case or carrier 14 preferably is made of a rigid yet flexible plastic material. The case or carrier 14 has a pair of generally C-shaped, laterally spaced parallel arms 80 and 82 formed integral with a connecting wall 84. The arms 80, 82 and wall 84 form a generally U-shaped flashlight receiving receptacle 86.

The arms 80 and 82 allow insertion of the flashlight 12 into the case 14 in the direction of the split-ring clip end 22 to a predetermined position (see FIG. 1). The arms 80, 82 of the case 14 frictionally contact with the opposite side walls 32*a*, 32*b* of the flashlight 12. This creates a "snap-in" type of retaining arrangement. Additionally, the connecting wall has a crowned ridge 84*a* formed at one end, and an integral, U-shaped mounting clip 90 at its other end.

Referring to FIG. 13, the crowned ridge 84*a* of the connecting wall 84 abuts the flashlight 12 when inserted, and prevents the flashlight from sliding too far into the case 14. When the flashlight 12 is inserted into the case 14 between the arms 80, 82 with the switch actuator button 60 exposed upwardly, as shown in FIG. 1, the flashlight will remain in an "OFF" state until the switch actuator button is manually depressed. In this position, the user must maintain pressure on the switch actuator button 60 to keep the LED 38 energized. Alternately, when the flashlight 12 is inserted within the arms 80, 82 of the case 14 with its switch actuator button 60 facing the connecting wall 84, the connecting wall cause and maintain pressure against the switch actuator button. Accordingly, the switch actuator button 60 will activate the momentary contact switch 75, placing the flashlight in an "ON" state until it is removed from the holder or carrier 14.

The U-shaped mounting clip 90 facilitates attachment of the case 14 to a support, such as a hat brim, a watch strap, a belt, or other articles of clothing or baggage. The U-shaped mounting clip 90 has a rounded, outwardly-curved free edge 90*a* and an upper edge 90*b* integrally connected with the connecting wall 84. Attaching the case 14 with the mounting clip 90 allows users to aim light from the flashlight in a desired direction, thereby leaving the user's hands free for other uses. Preferably, when the mounting clip 90 of the case 14 is unattached to any supports. The upper edge 90*b* lies at a distance 96 from the connecting wall 84, while the free end 90*a* rests on or nearer the connecting wall 84 (see FIG. 12). Preferably, the distance from the mounting clip 90 to the case connecting wall 84 is substantially the same thickness as a typical baseball-type cap brim, to allow the case 14 to attach securely to the hat brim.

Because the flashlight 12 is able to assume either an "OFF" state, or an "ON" while activated state within the case or carrier, it offers a simplicity and utility not found with prior art flashlights, which is valuable in both law enforcement and civilian settings. In addition, the flashlight 12 is designed to be assembled using fully automatic equipment, completely free of human intervention. This is possible, in part, because there are few parts to place, and because the parts may be easily placed adjacent or on top of a previously placed part without complex threading or interlocking of parts. The flashlight components are all assembled from a single side. Further, the design of the flashlight allows for liberal geometric tolerances, which facilitates the use of fully automatic assembly equipment. Automation of the assembly process dramatically increases the speed at which the flashlights 12 may be produced, as well as lowers the price per unit.

While a preferred embodiment of the flashlight and associated case in accordance with the present invention has been illustrated and described, it will be understood that changes in modifications may be made therein without departing from the invention in its broader aspects. Various features of the invention are defined in the following claims, and all modifications, variations, or equivalents that fall within the true spirit and scope of the basic underlying principles of the invention are intended to be encompassed in the following claims.

What is claimed is:

1. A flashlight, comprising:

a body portion with a forward end and a rearward end and opposing sides, the rearward end comprising a split-ring clip portion, the split-ring clip portion being formed by a first arm and a second arm, the arms being entirely molded along with the body of the flashlight, each arm projecting from one of the opposing sides of the forward end of the body to form the rearward end of the body such that the first arm and second arm overlie one another for an effective length to operatively form a ring clip operable by twisting the first arm apart from the second arm;

a light source carried by the body portion;

a power source carried in the body portion for energizing the light source; and a switch configured to operatively couple the power source and the light source.

2. The flashlight in accordance with claim 1 wherein the light source is a light emitting diode.

3. The flashlight in accordance with claim 2 wherein the power source is at least one battery.

4. The flashlight in accordance with claim 1 wherein the power source is a pair of coin-type batteries.

5. The flashlight in accordance with claim 3 wherein the light emitting diode has a pair of leads operatively disposed on opposite sides of the at least one battery.

6. The flashlight in accordance with claim 3 including an annular insulating spacer disposed between a surface of the at least one battery and the momentary contact switch operative to space the momentary contact switch out of electrical contact with the surface of the at least one battery.

7. The flashlight in accordance with claim 1 wherein the momentary contact switch includes a flexible disk formed of conductive material.

8. The flashlight in accordance with claim 3 further including an annular insulating spacer, and a flexible disk formed of conductive material disposed between the annular insulating spacer and one lead of the light emitting diode.

9. The flashlight in accordance with claim 1 wherein the body portion includes a cup-shaped recess defined by a bottom portion, sidewalls integrally formed with the bottom portion, and an open top portion.

10. The flashlight in accordance with claim 1 including a top cover having at least a portion formed of elastomeric material.

11. The flashlight in accordance with claim 10, wherein an underside of the top cover includes a plurality of concentric rings formed in the elastomeric material.

12. The flashlight assembly in accordance with claim 1 wherein the body portion is replaceable.

13. The flashlight in accordance with claim 1 wherein the body portion includes a replaceable bottom wall.

14. The flashlight in accordance with claim 13 wherein the replaceable bottom wall is formed of plastic.

15. A flashlight, comprising:

a body having a forward end and a rearward end, the rearward end comprising a split-ring clip portion, the split-ring clip portion being formed by a first arm and a second arm, the arms being entirely molded along with the body of the flashlight, each arm projecting from one of the opposing sides of the forward end of the body to form the rearward end of the body such that the first arm and second arm overlie one another over an effective length to operatively form a ring clip operable by twisting the first arm apart from the second arm;

a light source carried by a portion of the body;

a power source carried by the body;

a switch, configured to electrically couple the power source and the light source, the switch having surface extending outwardly from the body; and a top cover configured to cover a portion of the body, at least a portion of the top cover formed of an elastomeric material.

16. The flashlight in accordance with claim 15 wherein the light source is a light emitting diode.

17. The flashlight in accordance with claim 16 wherein the power source is at least one battery.

18. The flashlight in accordance with claim 15 wherein the power source is a pair of coin-type batteries.

19. The flashlight in accordance with claim 17 wherein the light emitting diode has a pair of leads operatively disposed on opposite sides of the at least one battery.

20. The flashlight in accordance with claim 17 including an annular insulating spacer disposed between a surface of the at least one battery and the momentary contact switch operative to space the momentary contact switch out of contact with the surface of the at least one battery.

21. The flashlight in accordance with claim 15 wherein the momentary contact switch includes a flexible disk formed of conductive material.

22. The flashlight in accordance with claim 16 further including an annular insulating spacer, and a flexible disk formed of conductive material disposed between the annular insulating spacer and one lead of the light emitting diode.

23. The flashlight in accordance with claim 15 wherein an underside of the top cover includes a plurality of concentric rings formed in the elastomeric material.

24. The flashlight in accordance with claim 15 wherein the body is replaceable.

25. The flashlight in accordance with claim 15 wherein the body includes a replaceable bottom wall.

26. The flashlight in accordance with claim 25 wherein the replaceable bottom wall is formed of plastic.

27. The flashlight in accordance with claim 25 wherein the replaceable bottom wall is configured to receive at least one of a plurality of indicia.

28. The flashlight in accordance with claim 27 wherein the indicia is selected from the group consisting of text, graphics, designs, and corporate logos.

29. The flashlight in accordance with claim 27 wherein the indicia is applied or affixed to the replaceable bottom by techniques selected from the group consisting of engraving, silk screening, inking, pad printed, foil stamping, and marking.

* * * * *